US010344540B2

(12) United States Patent
Nijjar et al.

(10) Patent No.: US 10,344,540 B2
(45) Date of Patent: Jul. 9, 2019

(54) COUPLING FOR HIGH STRENGTH RISER WITH MECHANICALLY ATTACHED SUPPORT MEMBERS WITH LOAD SHOULDERS

(71) Applicant: FMC TECHNOLOGIES, INC., Houston, TX (US)

(72) Inventors: Amrik S. Nijjar, Houston, TX (US); Jeremy D. Weise, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 15/768,646

(22) PCT Filed: Nov. 16, 2015

(86) PCT No.: PCT/US2015/060783
§ 371 (c)(1),
(2) Date: Apr. 16, 2018

(87) PCT Pub. No.: WO2017/086904
PCT Pub. Date: May 26, 2017

(65) Prior Publication Data

US 2018/0313166 A1 Nov. 1, 2018

(51) Int. Cl.
*E21B 17/01* (2006.01)
*E21B 17/042* (2006.01)
(Continued)

(52) U.S. Cl.
CPC ..... *E21B 17/01* (2013.01); *E21B 17/042* (2013.01); *E21B 17/085* (2013.01); *E21B 19/06* (2013.01); *E21B 19/10* (2013.01)

(58) Field of Classification Search
CPC ..... E21B 17/01; E21B 17/042; E21B 17/085; E21B 19/06; E21B 19/10
See application file for complete search history.

(56) References Cited

U.S. PATENT DOCUMENTS 221,673 A * 11/1879 Edelen ..... E21B 19/10 166/75.14
1,983,545 A * 12/1934 Johnson ..... E21B 19/08 173/165

(Continued)

FOREIGN PATENT DOCUMENTS

CA 2215755 A1 8/1998
WO 2011/034607 A1 3/2011

OTHER PUBLICATIONS

International Search Report and Written Opinion dated Oct. 7, 2016 for PCT/US2015/060783, filed on Nov. 16, 2015.

*Primary Examiner* — Matthew R Buck
(74) *Attorney, Agent, or Firm* — Amerson Law Firm, PLLC

(57) ABSTRACT

A riser includes a first pipe stand and a second pipe stand, wherein at least the first pipe stand includes a length of pipe and a coupling that is coupled to an upper end of the pipe, the coupling including a body. At least the first pipe stand further includes an upper support member and a lower support member, both of which are mechanically coupled to the body, the upper support member including an elevator engagement support shoulder and the lower support member including a riser weight load support shoulder that is adapted to support a weight load of the riser from a support structure, wherein the coupling with the upper support member and the lower support member coupled thereto is adapted to be lowered through the support structure after a lower end of the second pipe stand has been coupled to an upper end of the coupling.

21 Claims, 15 Drawing Sheets

(51) Int. Cl.

| | |
|---|---|
| ***E21B 19/06*** | (2006.01) |
| ***E21B 19/10*** | (2006.01) |
| ***E21B 17/08*** | (2006.01) |

(56) References Cited

U.S. PATENT DOCUMENTS

| | | | | |
|---|---|---|---|---|
| 2,719,025 | A * | 9/1955 | Stone | E21B 17/16 173/167 |
| 3,067,593 | A | 12/1962 | McCool | |
| 3,080,179 | A | 3/1963 | Huntsinger | |
| 3,094,852 | A | 6/1963 | Taylor | |
| 4,245,709 | A | 1/1981 | Manuel | |
| 4,487,434 | A | 12/1984 | Roche | |
| 4,549,613 | A | 10/1985 | Case | |
| 4,616,855 | A | 10/1986 | Ruhle | |
| 4,635,968 | A * | 1/1987 | Kuhne | E21B 17/1085 138/147 |
| 5,505,502 | A | 4/1996 | Smith | |
| 6,079,509 | A | 6/2000 | Bee et al. | |
| RE37,167 | E | 5/2001 | Wilson | |
| 6,349,764 | B1 * | 2/2002 | Adams | E21B 19/002 166/368 |
| 6,361,251 | B1 * | 3/2002 | Soltanahmadi | E21B 19/06 166/75.14 |
| 6,364,012 | B1 * | 4/2002 | Adams | E21B 19/002 166/368 |
| 6,378,614 | B1 * | 4/2002 | Adams | E21B 19/002 166/368 |
| 6,598,673 | B1 | 7/2003 | Hosie et al. | |
| 6,644,413 | B2 * | 11/2003 | Adams | E21B 19/002 166/368 |
| 6,688,814 | B2 * | 2/2004 | Wetch | E21B 19/004 166/355 |
| 7,025,147 | B2 * | 4/2006 | Adams | E21B 19/002 166/368 |
| 7,044,216 | B2 * | 5/2006 | Otten | E21B 19/06 166/75.14 |
| RE39,869 | E | 10/2007 | Payne et al. | |
| 7,793,994 | B2 | 9/2010 | Boyd | |
| 8,021,081 | B2 * | 9/2011 | Crotwell | E21B 19/002 166/355 |
| 8,047,283 | B2 | 11/2011 | Jahn et al. | |
| 8,678,447 | B2 | 3/2014 | Chin | |
| 8,944,723 | B2 * | 2/2015 | Garcia | E21B 19/004 166/355 |
| 9,010,436 | B2 * | 4/2015 | Kubichek | E21B 19/004 166/355 |
| 2008/0078081 | A1 | 4/2008 | Huff et al. | |
| 2011/0232895 | A1 | 9/2011 | Klotz et al. | |
| 2015/0041152 | A1 | 2/2015 | Klotz et al. | |

* cited by examiner

COUPLING FOR HIGH STRENGTH RISER WITH MECHANICALLY ATTACHED SUPPORT MEMBERS WITH LOAD SHOULDERS

FIELD OF INVENTION

The present invention relates to risers that may be used in the oil and gas industry and, more particularly, to a unique high-strength coupling for a high strength riser with mechanically attached support members with load shoulders.

BACKGROUND OF THE INVENTION

After an oil/gas well is drilled and completed (so that production may proceed) it may become necessary to access the oil/gas well to perform various "workover" operations. Such workover operations may include a variety of process operations including, but not limited to, replacing various components, stimulating the production from the oil/gas well by chemical treatments, etc. In the case of subsea oil/gas wells, such workover operations are performed through a workover riser that extends from a workover vessel or ship on the surface of the water to the well equipment positioned at the bottom of the sea. In particular, such a workover riser may extend from a surface vessel to a Christmas tree positioned above the wellhead of the subsea well. A riser may also be used in other situations as well, such as when installing a Christmas tree on or above a subsea wellhead.

Typically, in subsea applications, such a workover riser may extend beneath the surface of the water for a very long distance, e.g., 1.5 miles or more, depending upon the depth of the well and the depth of the water. Traditionally, such risers are comprised of multiple tubular components or pipes that are threadingly coupled to one another using pin/box connections. In one embodiment, such a workover riser may be comprised of sections or "stands" of tubular pipes, wherein each stand is comprised of multiple tubular pipe segments that are coupled to one another using a coupling. Multiple such stands of tubulars are sequentially inserted into the water to create the riser. More specifically, when inserting a stand of tubulars for increasing the overall length of the workover riser, the stands of tubulars are sequentially connected to one another as the workover riser is increased in length as it is extended toward the well head at the sea floor. Conversely, in the case where a workover riser is removed from an oil/gas well, each stand of such tubulars is unscrewed from the overall riser string and positioned on the deck of the workover vessel. When inserting or removing a stand of tubulars, the portion of the riser that remains below the vessel is supported by the vessel.

Within the oil gas industry, powered pipe tongs are typically used for threadably engaging and disengaging tubular goods, such as drill pipes, and pipe sections for workover risers, etc. Such tongs typically have hardened metal gripping teeth that bite into and penetrate a surface of the engaged component. In operation, a first tong engages the first of two tubular components to be joined together, while a second tong engages the second tubular that is to be joined to the first tubular. The tongs are then power driven to so as to provide relative rotation between the first and second tongs so as to threadingly couple/decouple the two tubulars to or from one another, respectively.

More specifically, a typical workover vessel includes a platform and power tools such as one or more elevators and a spider that are used to engage, assemble, and lower the stand of tubulars into the water. The elevator is suspended above a floor of the vessel by a draw works that can raise or lower the elevator in relation to the floor of the vessel. The spider is mounted in the floor. The elevator and spider both have so-called "slips" that is capable of engaging and releasing a tubular. The elevator and the spider are designed to work in tandem. Generally, the spider is actuated such that it engages and holds the uppermost stand of the riser so as to support the entire weight of the riser positioned below the vessel while another stand of pipes is added to the workover riser positioned below the vessel. In general, the elevator engages a new stand of tubulars (upper stand) and aligns it over the stand (the lower stand) of the riser that is being held in position by the spider. Thereafter, the tongs, e.g., a power tong and a spinner, are then moved into position so as to physically engage the upper and lower stands of tubulars. At least one of the tongs is then energized to cause the upper and lower stands to rotate relative to one another so as to couple the upper stand and the lower stand together. Once the upper and lower stands of tubulars are coupled to one another, the elevator is then actuated to raise the riser, and the spider is then disengaged from the lower stand. The elevator is then used to lower the riser through the floor until the elevator and spider are at a predetermined distance from each other. The spider then re-engages the uppermost stand of the workover riser and the elevator is then disengaged from the stand of the riser that is now being held by the spider. This process is repeated until such time as the desired overall length of the riser is assembled. As indicated above, this sequence can be reversed to disassemble the riser.

Importantly, the tongs and slips have inserts with teeth that are forced against the wall of the pipe. It is well known in the industry that such tongs and slips mar or penetrate, i.e., create notches or gouges, in the surface of the component that they engage. The presence of such notches, scratches or gouges in the component may set up undesirable stress risers in the pipe. It is also well known that steel fails under repeated loading and unloading, or under reversal of stress, at stresses smaller than the ultimate strength of the steel under static loads. The magnitude of the stress required to produce failure decreases as the number of cycles of stress increase. This phenomenon of the decreased resistance of steel to repeated stresses is called "fatigue" that leads to fatigue cracking.

More recently, oil and gas producers have been drilling deeper wells in deeper water in an effort to maintain or increase their reserves of oil and gas. Although what constitutes an "ultra deep-water" well is a matter of opinion, based upon current technology, ultra deep water-wells are commonly thought to be wells that are drilled in at least 6000 feet of water. Many of such wells drilled in deeper water may also be subjected to "High Temperature High Pressure" (HPHT) conditions, i.e., the operating formation pressures and temperatures within the well. Just like the wellhead components, workover risers for use on such HPHT wells must also be rated for the HPHT service conditions. Yet another variable that must be considered when designing a subsea riser is the nature and characteristics of the hydrocarbons produced from the well. For example, some wells produce hydrocarbons that contain hydrogen sulfide ($H_2S$). Such wells are sometimes referred to as "sour service" wells. Hydrogen sulfide is known to cause stress corrosion cracking in high-strength materials such as high-strength low-alloy carbon steel. In wells that involve production of corrosive materials, such as $H_2S$, alloys such as chromium and/or molybdenum may be added to the materials used for the riser in such applications in an effort to avoid or limit stress corrosion cracking. Operators of "sour service" wells require that riser materials be "NACE qualified" by passing a testing regime specified by NACE MR0175, wherein "NACE" refers to the corrosion prevention organization formerly known as the National Association of Corrosion Engineers, now operating under the name NACE International, Houston, Tex.

All of the aforementioned issues must be addressed when designing risers that are intended for use in connection with a deep-water, HPHT and sour service well. First, for very long risers (required in deep-water applications), the use of low strength materials (yield strength of 85 ksi or less) for the riser components is not acceptable due to the fact that the riser becomes very heavy due to the relatively large thickness of the low strength material that is required to support all imposed loads on the riser. For example, a riser made of such low-strength materials may not be able to support the weight of the riser itself and/or withstand the stresses imposed on such long risers, including being subjected to internal formation pressures during at least some workover operations. Accordingly, risers for deep-water HPHT applications that do not involve sour service wells, may be made of so-called "high-strength" materials, materials having a yield strength of at least 90 ksi so as to reduce the thickness of the various components of the risers, e.g., the pipes, and thereby reduce the overall weight of the riser. For deep-water HPHT wells that are also subjected to sour service conditions, a balancing of various factors is required when designing such risers, as will be discussed more fully below.

FIG. 1 depicts an example of an illustrative stand of tubulars 20 of a workover riser, wherein the riser 20 is manufactured using so-called "high strength" materials, i.e., materials with a yield strength of 90 ksi or greater, sometimes referred to as low-alloy steels. In the depicted example, the stand of tubulars 20 is comprised of two sections of high-strength pipe 22A, 22B, an upper high-strength coupling 24A and a lower, high-strength coupling 24B. FIG. 1 also includes enlarged views of portions of the riser 20. The overall length 29 of the stand of tubulars 20 may vary depending upon the particular application, e.g., about 45 feet. In the depicted example, the overall stand of pipes 20 has an upper box connection 26 and a lower pin connection 28. The nominal diameter of the pipe sections 22A, 22B may vary depending upon the particular application, e.g., 7⅞ inches.

As shown in the enlarged views, upper high-strength coupling 24A also comprises two box connections, the upper one of which serves as the box connection 26 for the overall stand 20, while the lower box connection is coupled to the pin connection of the pipe 22A. Similarly, the lower high-strength coupling 24B also comprises two box connections, the upper one of which is coupled to the pin connection of the pipe 22A, while the lower box connection is coupled to the upper pin connection of the pipe 22B. The high-strength couplings 24A, 24B are couplings that are made to precise specifications and manufactured using known rolling and extrusion manufacturing techniques followed by machining of the threads for the box/pin connections.

Making connections between such high-strength stands of pipe 20 using power tongs can be problematic. In general, power tongs should only come into contact with the couplings 24A, 24B so as to avoid in gouging penetration of the surface of the high-strength pipes 22A, 22B. When joining two stands 20 together, one of the tongs will engage the coupling (24A, 24B) of the first stand, but the other tong must engage the pipe on the other stand. As a result, the surface of the high-strength pipes 22A, 22B becomes scarred, gouged or damaged due to undesired contact or engagement with the teeth of the power tongs. The net result is that the life of the high-strength pipes 22A, 22B may be greatly reduced. Additionally, the coupling 24A does not have any significant shoulder that is useful for engagement by an elevator or a spider. Note that the coupling 24B may be attached to the pipes 22A, 22B in the factory using special equipment, i.e., using protective layers positioned between the tong dies and outside diameter of the pipe Typically, the lifting and makeup of such stands 20 is accomplished by use of devices that have special "non-marking" slips and tongs which do not damage the pipes 22A, 22B. These additional special slips and tongs can cause additional costs and delays as it related to the overall project of frequent installation of a riser for a subsea well.

FIG. 2 is an example of an illustrative stand of tubulars 10 of a workover riser, wherein the riser is manufactured using so-called "high strength" materials, i.e., materials with a yield strength of 90 ksi or greater, such as low-alloy carbon steel. In depicted example, the stand of tubulars 10 is comprised of two sections of high-strength pipe 12A, 12B, an intermediate high-strength coupling 14, an upper, machined, low-strength forging 16 and a lower, machined low-strength forging 18, wherein the forgings 16, 18 are made of a material having a yield strength of 85 ksi or less. FIG. 2 also includes enlarged views of the high-strength coupling 14 and the low-strength forgings 16 and 18. The overall length 19 of the stand of tubulars 10 and diameter of the pipes 12A, 12B may be about the same as those set forth for the riser described in FIG. 1.

As shown in the enlarged view of the upper forging 16, the upper forging 16 is comprised of a forged body 16A, an upper pipe connection 16B, a lower pipe connection 16C, a riser support shoulder 16D, an elevator support shoulder 16E and a tong-engagement area 16F positioned above the elevator support shoulder 16D. The overall axial length of the upper forging 16 may vary depending upon the particular application, e.g., five feet. In the depicted example, the upper and lower pipe connections 16B, 16C, are both box connections. As depicted, the lower pipe connection 16C is coupled to the pin connection on the pipe section 12A. To manufacture the upper forging 16, an initial forging is obtained and various machining operations are performed to define at least the riser support shoulder 16D and the elevator support shoulder 16E in the outer portion of the forged body 16A and to define the axial bore that extends through the body 16A of the upper forging 16 as well as the pipe connections 16B, 16C. The intermediate coupling 14 also comprises two box connections that engage the pin connections on the pipe sections 12A, 12B. The intermediate coupling 14 is typically made to precise specifications and manufactured along with the pipes 12A, 12B using known rolling and extrusion manufacturing techniques followed by machining of the threads for the box/pin connections.

As shown in the enlarged view of the lower forging 18, the lower forging 18 is comprised of a forged body 18A, an upper pipe connection 18B, a lower pipe connection 18C, a support shoulder 18D and a tong-engagement area 18E. The overall axial length of the lower forging 18 may vary depending upon the particular application, e.g., 3-5 feet. In the depicted example, the upper pipe connection 18B is a box connection that is adapted to engage the pin connection on the pipe section 12B. The lower pipe connection 18C is a pin connection that is adapted to engage the box connection 16B on another stand of pipe 10. To manufacture the lower forging 18, an initial forging is obtained and various machining operations are performed to define at least the shoulder 18D in the outer portion of the forged body 18A and to define the axial bore that extends through the body 18A of the lower forging 18 as well as the pipe connections 18B, 18C.

During operations, the support shoulder 16D of the upper forging 16 is engaged by the spider to maintain the entire weight of the riser below the vessel at the surface of the sea. Thereafter, an elevator (not shown) engages the elevator support shoulder 16E on another stand of pipe 10, lowers the pin connection 18C into engagement with the box connection 16B of the pipe section that is engaged by the spider. Thereafter, a lower power tong (or similar torque-generating device) (not shown) is positioned around and engages the surface 16F of the pipe stand 10 that is engaged by the spider, while an upper power tong (or similar torque-generating device) (not shown) is positioned around and engages the surface 18E of the pipe stand 10 that was just positioned above the pipe stand 10 engaged by the spider using the elevator. Thereafter, the power tongs are actuated so as to tighten the connection between the two stands of pipe 10. The elevator is coupled to the now combined stand of pipe 10, the spider is retracted, and the elevator lowers the assembled pipe stands into the water below the vessel.

As mentioned above, it is well known that steel fails under repeated loading and unloading, or under reversal of stress, at stresses smaller than the ultimate strength of the steel under static loads. The magnitude of the stress required to produce failure decreases as the number of cycles of stress increase. This phenomenon of the decreased resistance of steel to repeated stresses is called "fatigue". The danger of such fatigue cracks appearing is greater if the stress within a material is increased or concentrated due to the presence of a stress concentrator, such as, for example, a local defect such as a notch or significant scratch that penetrates the outer surface of the material, such as defect that is produced when the teeth of power tongs or slips engage a pipe. Once formed, the crack tends to spreads due to the stress concentrations at its ends. This spreading of the crack progresses under the action of the alternating stresses until the cross-section becomes so reduced in area that the remaining portion fractures suddenly under the load.

The present application is directed to a unique coupling for a high strength riser with mechanically attached support members that may eliminate or at least minimize some of the problems noted above.

BRIEF DESCRIPTION OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present application is generally directed to a various embodiments of a unique coupling device for use in a high strength riser with mechanically attached support members with load shoulders. In one illustrative embodiment, the riser includes, among other things, a first pipe stand and a second pipe stand, wherein at least the first pipe stand includes a length of pipe and a coupling that is coupled to an upper end of the pipe, the coupling including a body. At least the first pipe stand also includes an upper support member and a lower support member, both of which are mechanically coupled to the body. Additionally, the upper support member includes an elevator engagement support shoulder and the lower support member includes a riser weight load support shoulder that is adapted to support a weight load of the riser from a support structure, wherein the coupling with the upper support member and the lower support member coupled thereto is adapted to be lowered through the support structure after a lower end of the second pipe stand has been coupled to an upper end of the coupling.

BRIEF DESCRIPTION OF THE DRAWINGS

The present invention will be described with the accompanying drawings, which represent a schematic but not limiting its scope.

Figure 1:
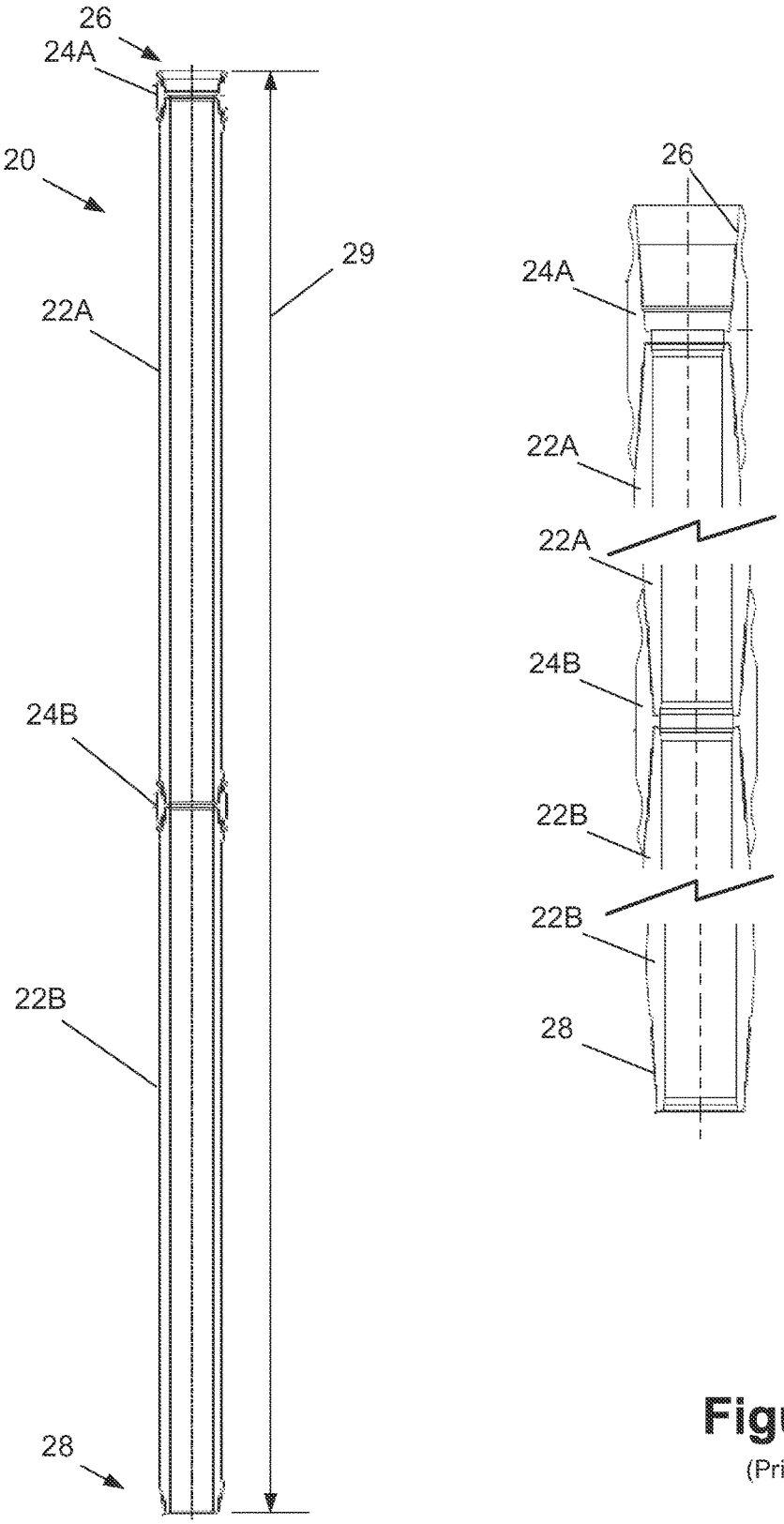
Figure 1 (Prior Art)
FIG. 1 depicts an illustrative prior art workover riser.
Figure 2:
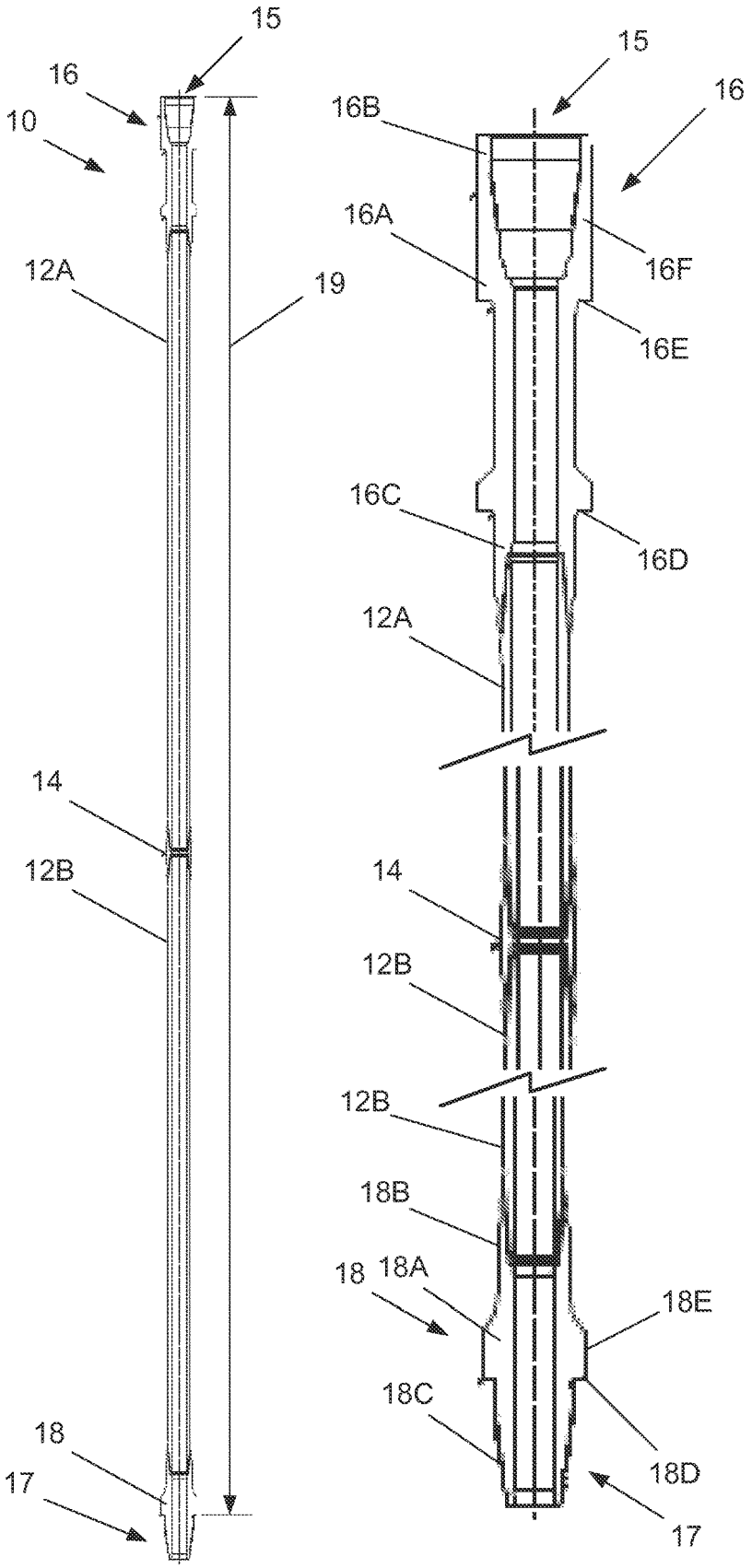
Figure 2 (Prior Art)
FIG. 2 depicts yet other illustrative prior art workover riser.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase. As used herein and in the attached claim, the terms "high-strength material" or "high-strength" shall be understood to mean a material with a yield strength of 90 ksi or greater (as determined per ASTM A370) and the terms "low-strength material" or "low-strength" shall be understood to mean a material with a yield strength of 85 ksi or less (as determined per ASTM A370. Additionally, the term "coupling stock" as used herein and in the claims shall be understood to mean a material that is manufactured by rolling and extrusion manufacturing techniques per API SPEC SCT, but the term "coupling stock" does not include materials made by forging processes manufactured pursuant to ASTM specification A182.

Figure 3:
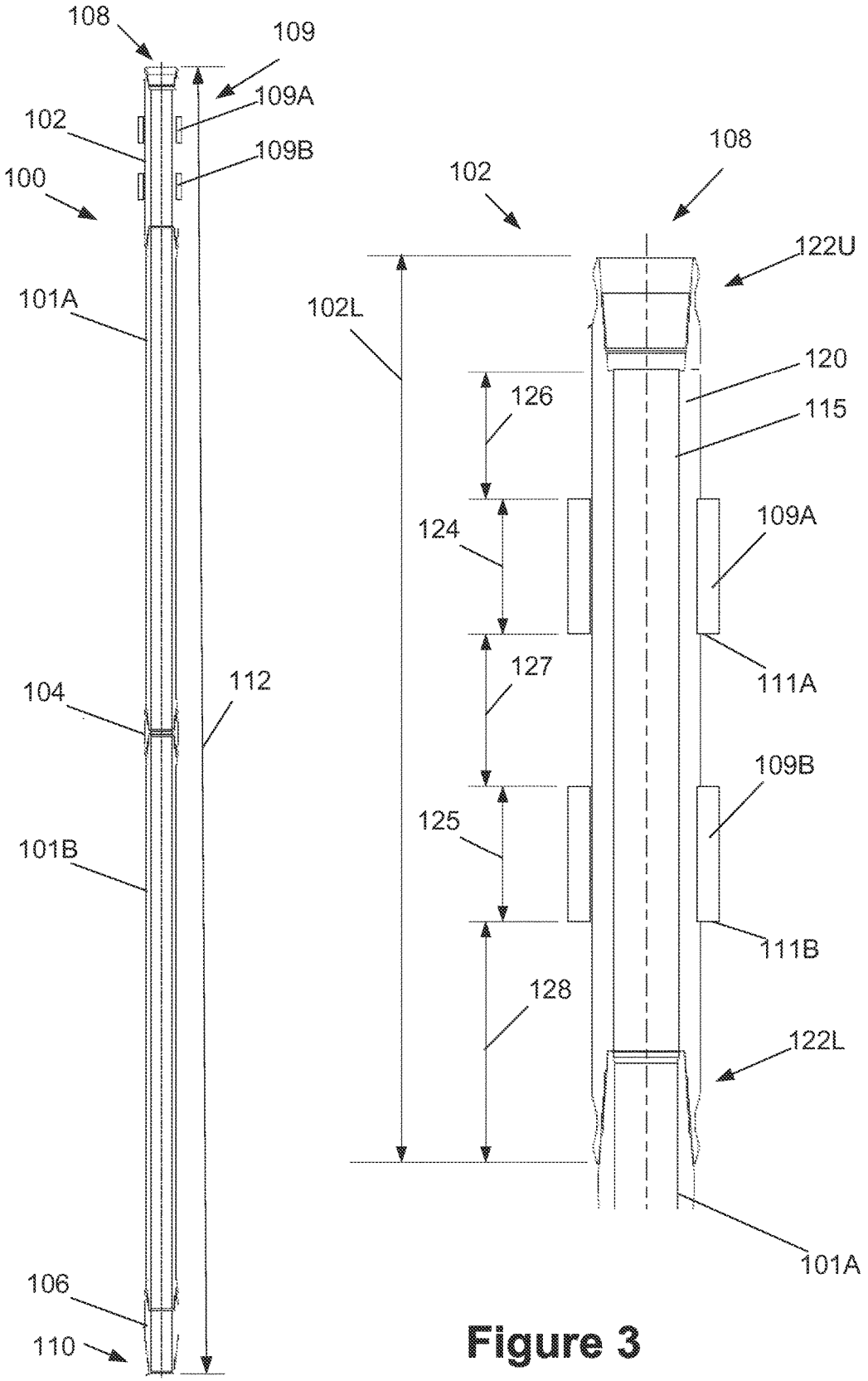
FIGS. 3-13 depict various embodiments of a unique coupling for a high strength riser with mechanically attached support members with load shoulders disclosed herein.
Figure 4:
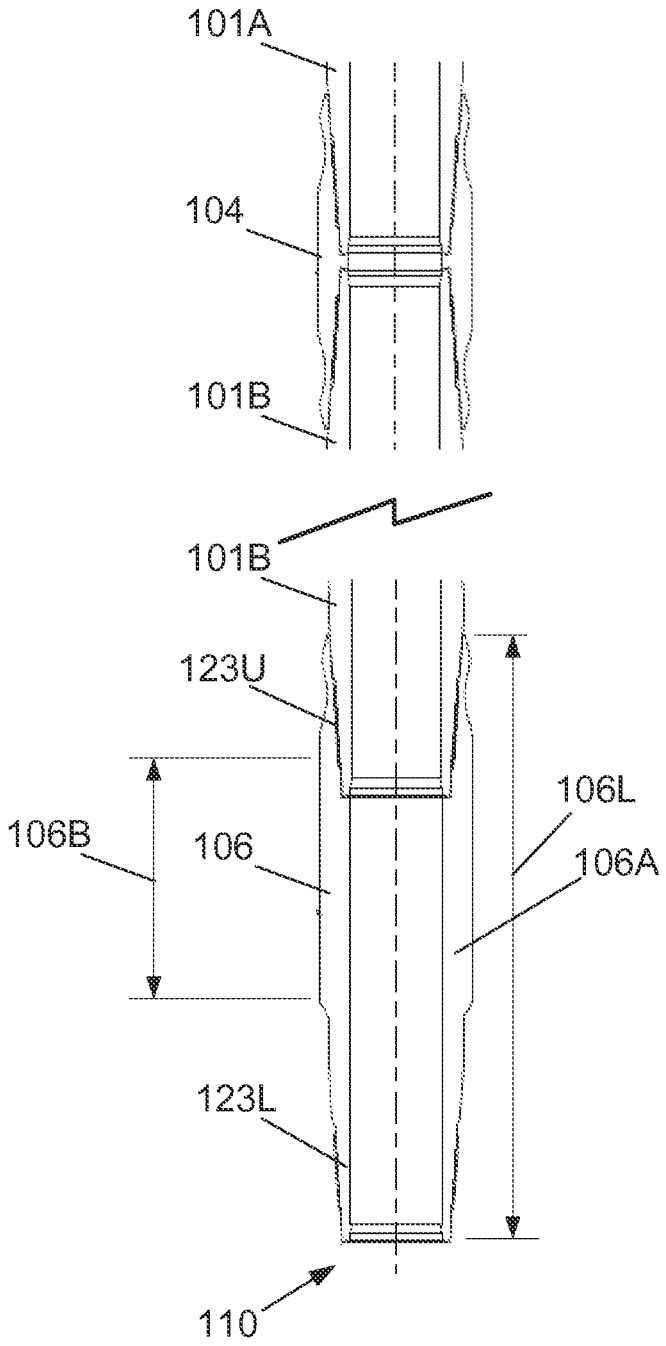

FIGS. 3 and 4 depict an example of an illustrative stand of tubulars or pipes 100 of a workover riser, wherein the riser is manufactured using high-strength materials. FIGS. 3 and 4 also include enlarged views of portions of the stand of pipes 100. In the depicted example, the stand of tubulars or pipes 100 is comprised of two sections of high-strength pipe 101A, 101B, an upper extended-length, high-strength coupling 102, an intermediate high-strength coupling 104 and a lower, high-strength coupling 106. Also shown in FIGS. 3 and 4 are schematically depicted support members 109 (upper support member 109A and lower support member 109B). The upper support member 109A comprises an elevator engagement support shoulder 111A, while the lower support member 109B comprises a riser weight load support shoulder 111B (both of which will be collectively referenced using the reference number 111). The support members 109 are mechanically attached to the body 120 of the upper coupling 102 using various techniques and mechanisms that will be more fully described below.

The overall length 112 of the stand of tubulars 100 may vary depending upon the particular application, e.g., about 45 feet. In the depicted example, the overall stand of pipes 100 has an upper box connection 108 and a lower pin connection 110. The nominal diameter of the pipe sections 101A, 101B may vary depending upon the particular application, e.g., 7⅞ inches. As shown in the enlarged view on FIG. 3, in the depicted example, the upper coupling 102 comprises a body 120, an upper box connection 122U and a lower box connection 122L. The upper box connection 122U serves as the box connection 108 for the overall stand 100 and the lower box connection 122L is adapted to be coupled to the pin connection of the pipe 101A. As show in FIG. 4, the intermediate coupling 104 comprises two box connections, the upper one of which is adapted to be coupled to the pin connection of the pipe 101A, while the lower box connection is adapted to be coupled to the upper pin connection of the pipe 101B. With continuing reference to FIG. 4, the lower coupling 106 comprises an upper box connection 123U and a lower pin connection 123L. The upper box connection 123U is adapted to be coupled to the lower pin connection of the pipe 101B, while the lower pin connection 123L is adapted to be coupled to the upper pin connection 108 of another stand of pipes 100 (not shown) when assembling the riser. Of course, after a complete reading of the present application, those skilled in the art will recognize that the illustrative arrangement of the box and pin connections depicted in FIGS. 3 and 4 may be readily modified depending upon the desired configuration of the components of the riser. For example, in some applications it may be desirable that the upper connection 122U of the upper coupling 102 be a pin connection and the lower connection 123L of the lower coupling 106 be a box connection. In yet other applications, the upper coupling 102 may only have a single threaded pipe connection, such as the depicted upper box connection 122U. The lower end of the coupling 102 may be welded or bolted to the upper pipe 101A (via flanged connections). Thus, the illustrative arrangement of the pin and box connections on the component parts of the riser depicted herein should not be considered to be a limitation of the presently disclosed inventions unless such limitations are expressly recited in the attached claims.

With continuing reference to FIG. 3, the overall axial length 102L of the upper coupling 102 may vary depending upon the particular application. For example, in one illustrative embodiment, the axial length 102L may be about 6.5 feet. The diameter of the internal opening 115 in the upper coupling 102 will approximately match that of the pipes 101A, 101B. As noted above, the upper support member 109A comprises the support shoulder 111A that is adapted to be engaged by an elevator (not shown). The lower support member 109B comprises the riser weight load support shoulder 111B that is adapted to be positioned in contact with a support structure on a vessel, e.g., an operations platform, so as to thereby support the entire weight of the riser positioned below the vessels when pipe stands 100 are being added to or removed from the riser.

In the depicted example, the support members 109 are physically separate components that are coupled to the body 120 in a vertically spaced-apart arrangement. In some applications, the support members 109 may each have the same physical configuration, but that may not be the case in all applications. In the depicted example, the upper support member 109A has an axial length 124 while the lower support member 109B has an axial length 125. In one illustrative example, the axial lengths 124, 125 may be the same and they may be about 5 inches. A tong gripping area 126 is provided above the upper support member 109A. In one illustrative example, the axial length of the tong gripping area 126 may be about 15 inches. The upper support member 109A and the lower supper member 109B are axially spaced apart by a distance 127 that should be large enough to permit an elevator (not shown) to be positioned between the support members 109 such that the elevator can engage the shoulder 111A on the upper support member 109A. In one illustrative example, the axial length 127 may be about 20 inches. The support shoulder 111B on the lower support member 109B is positioned above the lower end of the upper coupling 102 by a distance 128. In one illustrative example, the distance 128 may be about 24 inches. As will be appreciated by those skilled in the art after a complete reading of the present application, the vertical distance between the shoulder 111B on the lower support member 109B and the shoulder 111A upper support member 109A (the combination of the distances 125 and 127) should be such that, when the lower shoulder 111B of the lower support member 109B is engaged with a support structure on the vessel, the vertical location of the tong contact area 126 is at a height that is comfortable for men working on the vessel who will assemble and disassemble the riser. With reference to FIG. 4, the lower coupling 106 has a body 106A, an axial length 106L and a tong engagement area 106B. The axial length 106L of the lower coupling 106 may vary depending upon the particular application, e.g., 18 inches. The high-strength intermediate coupling 104 may be made to precise specifications and manufactured using known rolling and extrusion manufacturing techniques followed by machining of the threads for the box connections.

Additionally, the coupling 104 may be attached to the pipes 101A, 101B in the factory using special equipment, i.e., using protective layers positioned between the tong dies and outside diameter of the pipe.

As to materials of construction, components of the stand of pipes 100 are made of high-strength material, unless specifically noted otherwise herein. In one very particular embodiment, the upper coupling 102 and the lower coupling 106 are made of high-strength coupling stock material that is formed to a desired outside diameter and inside diameter using rolling and extrusion manufacturing techniques followed by the machining of the threads, but does not include materials made by forging processes. Of course, if desired, in another embodiment, the body of the upper coupling 102 and the lower coupling 106 may be made of high-strength forged materials. However, by manufacturing upper and lower couplings 102, 106 from coupling stock material instead of forgings, the cost of overall riser may be greatly reduced. Moreover, some expensive and time consuming machining operations may be eliminated when coupling stock material is employed instead of forgings for such components.

In the embodiments shown in FIGS. 5-11, the support members 109 may be comprised of one or more ring segments 113 that are secured around the body 120 using various techniques and mechanisms, as will be described more fully below. In the embodiments in FIGS. 5-11, the engagement mechanism between the support members 109 and the body 120 of the upper coupling 106 comprises a plurality of mating grooves 140 and teeth 142 formed in the body 120 and the support members 109, e.g., a plurality of circular grooves 140 that are adapted to engage and mate with a corresponding plurality of teeth 142 arranged in a circular configuration on the other component. In the embodiment shown in FIGS. 9-10 each of the support members 109 may be a one-piece partial ring segment 113X that engages the body 120 much like a snap-ring, as will be described more fully below. In the embodiment shown in FIG. 12, the support members 109 are mechanically coupled to the body 120 by a threaded connection 170.

Figure 5:
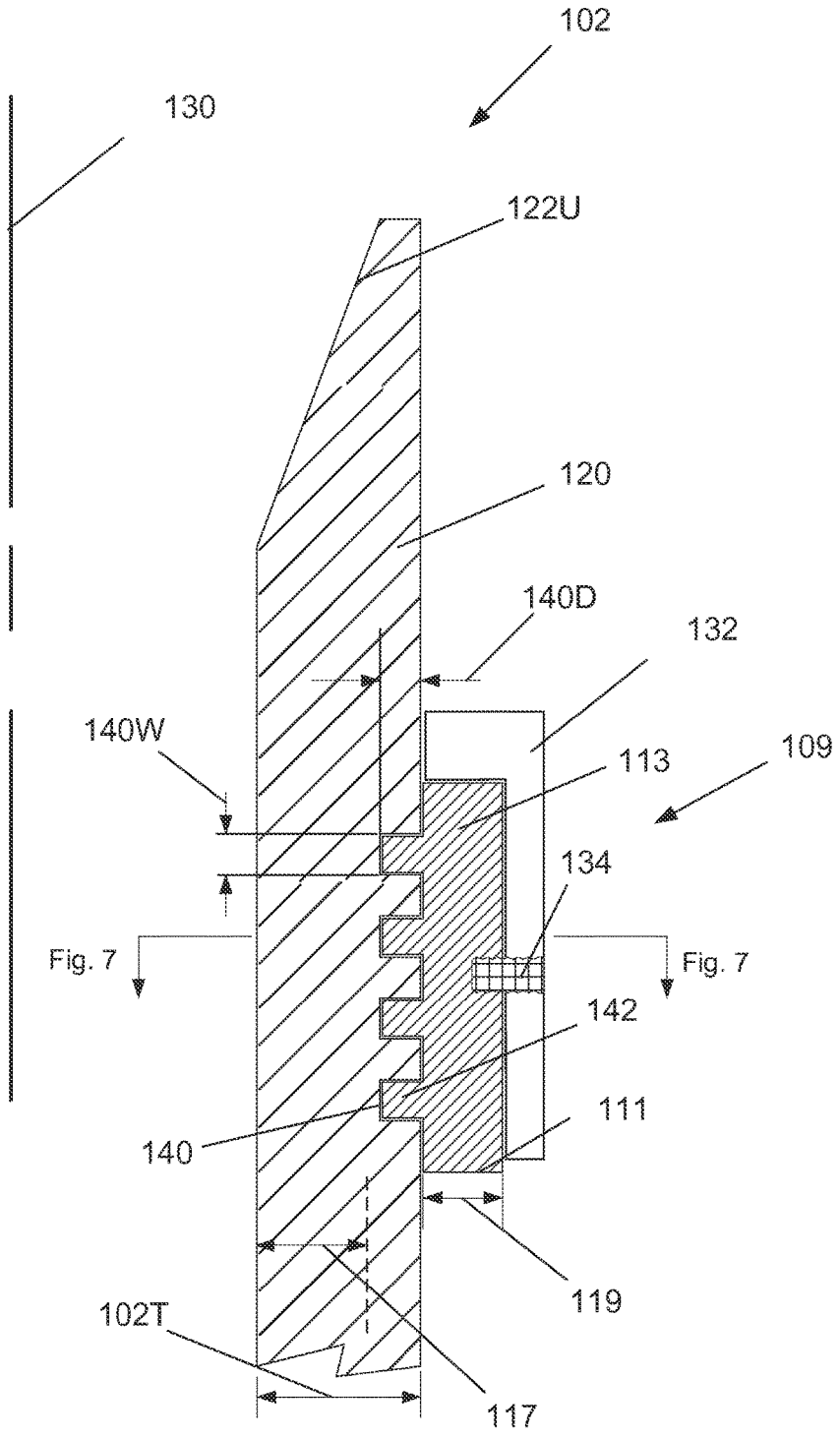
Figure 6:
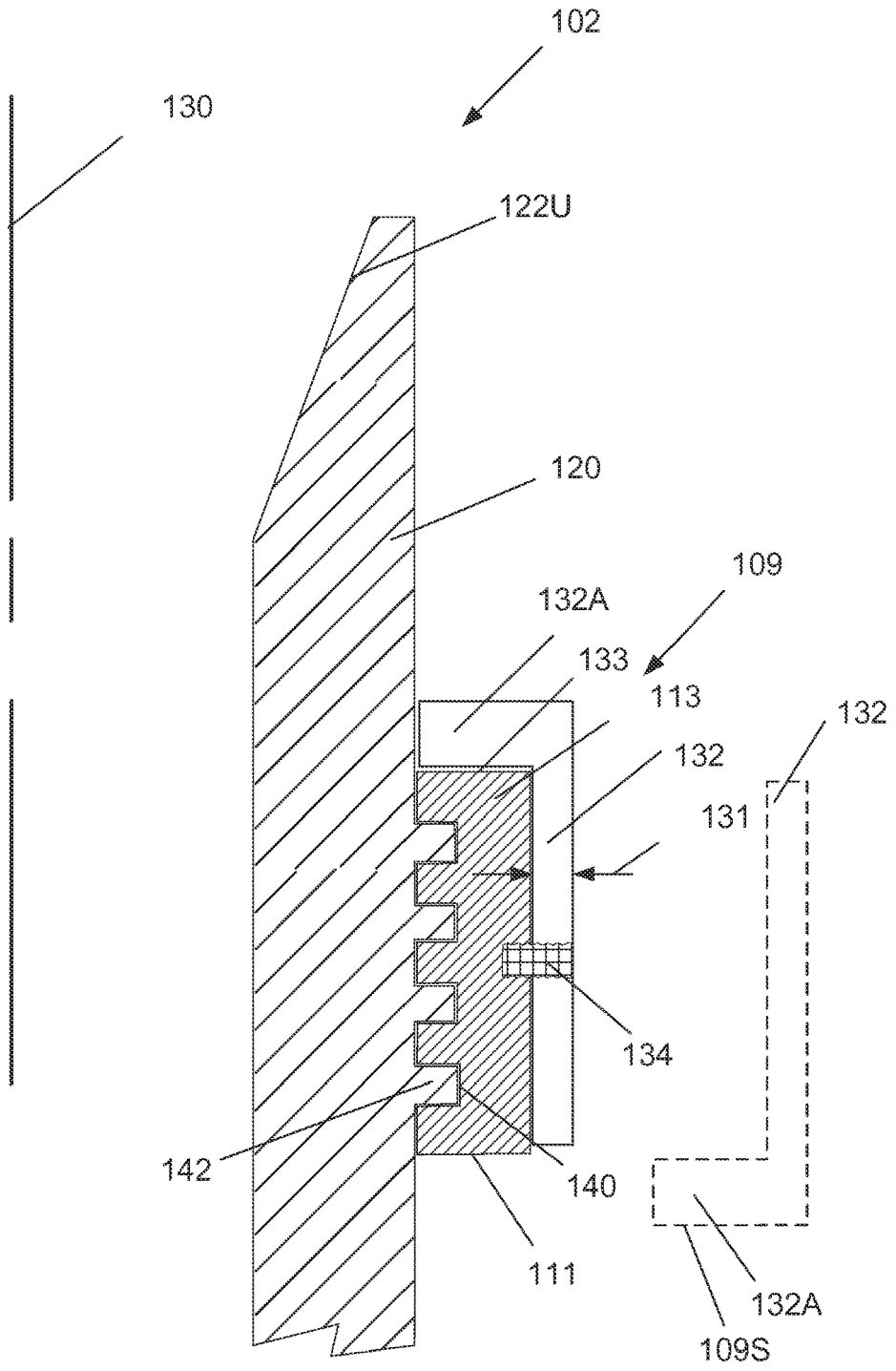
Figure 7:
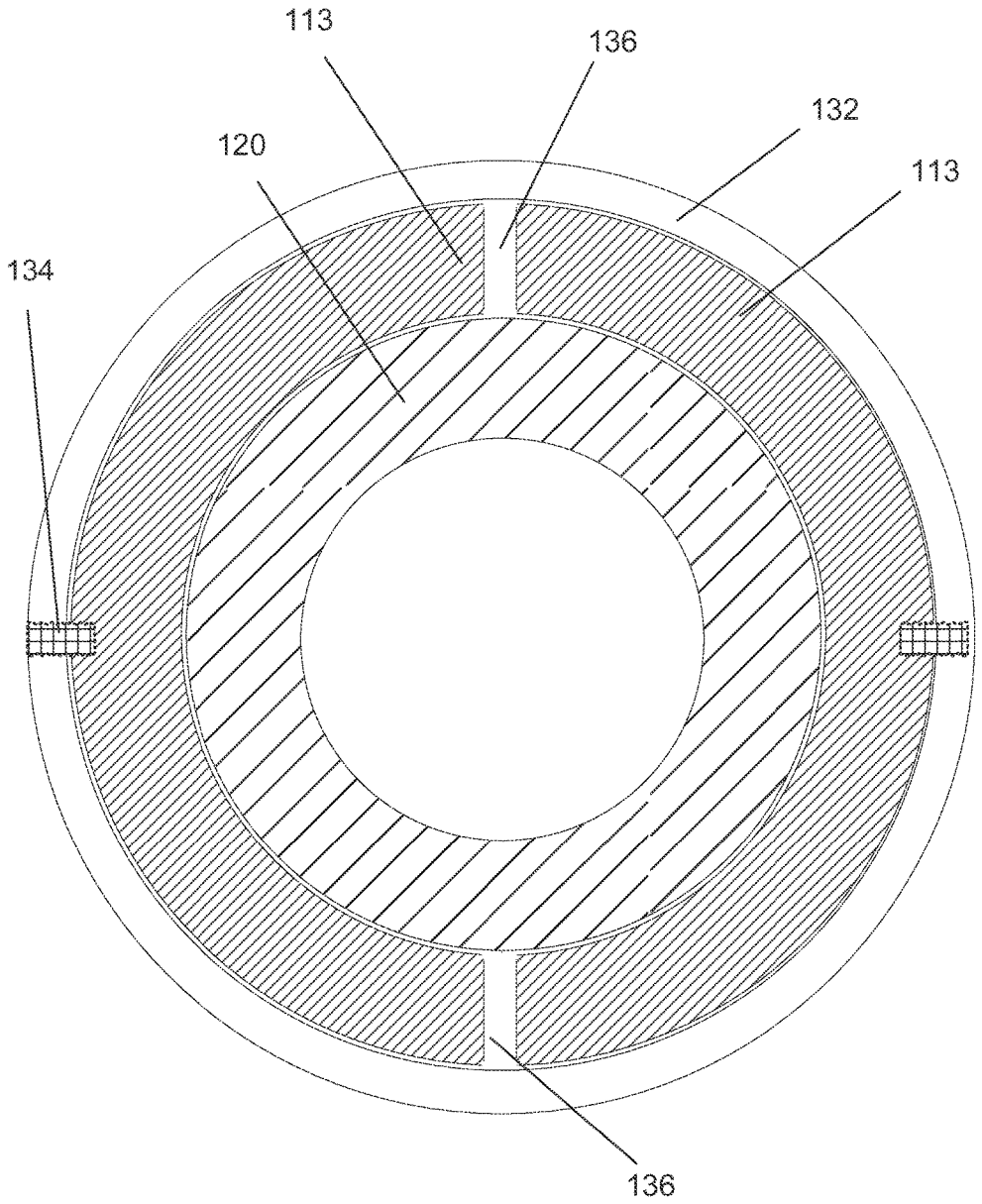

FIGS. 5 and 6 are cross-sectional views of a portion of an illustrative embodiment of the upper coupling 102 wherein the upper and lower support members 109A, 109B have the same physical configuration and engage the body 120 using the same mechanism. Thus, only a single support member 109 is shown in FIGS. 5 and 6 (as well as the other drawings in this application). The centerline 130 of the upper coupling 102 is also depicted. In the illustrative embodiment shown in FIGS. 5-7, the support members 109 are comprised of one or more partial ring segments 113 and a retaining ring 132. The retaining ring 132 is used to secure the ring segments 113 in the engaged position with the body 120 of the upper coupling 102. The retaining ring 132 is coupled to the ring segments 113 of the support member 109 by a plurality of simplistically depicted set screws 134. FIG. 7 is a cross-sectional view taken where indicated in FIG. 5. As shown in FIG. 7, in this illustrative example, each of the two support members 109 are made of two ring segments 113, wherein each of the ring segments 113 cover less than 180 degrees of the outer circumference of the body 120. Accordingly, two gaps 136 are present between the two segments of each of the support members 109. Of course, the support members 109 may comprise any number of ring segments such ring segments 113. If desired, the support member 109 may be disassembled from the engaged position with the body 120 by removing the retaining ring 132.

As shown in FIG. 5, the grooves 140 may be formed in the body 120 of the upper coupling 102 and the corresponding teeth 142 may be formed in the support members 109. In the embodiment shown in FIG. 6, the grooves 140 may be formed in the support members 109 and the corresponding teeth 142 may be formed in the body 120 of the upper coupling 102. The formation of the grooves 140/teeth 142 on either of the engaging components applies to all embodiments disclosed herein.

As will be appreciate by those skilled in the art after a complete reading of the present application, the interaction between these engaged grooves 140/teeth 142 will support the riser when pipe stands 100 are added to or removed from the riser. More specifically, when the support shoulder 111B of the lower support member 109B is resting on a structure (not shown) on the vessel, the interaction between the grooves 140/teeth 142 of the lower support member 109B and the body 120 of the upper coupling 102 will support the entire weight of the riser positioned below the vessel. Similarly, when an elevator (not shown) engages the shoulder 111A of the upper support member 109A and lifts the riser, the interaction between the grooves 140/teeth 142 of the upper support member 109A and the body 120 of the upper coupling 102 will support the entire weight of the riser that is suspended from the elevator. The size, location, number, of the grooves 140/teeth 142 are designed to withstand at least the shearing loads imposed on the grooves 140/teeth 142 during such operations.

In general, the grooves 140/teeth 142 may have any desired configuration, and the dimensions of the grooves 140/teeth 142 may vary depending upon the particular application. For example, with reference to the embodiment shown in FIG. 5, the grooves 140 may, in one embodiment, be substantially continuous grooves that are machined in the body 120 around the entire circumference of the body 120, while the corresponding teeth 142 are machined into the ring segments 113. FIG. 6 depicts an embodiment wherein the grooves 140 are formed in the ring segments 113 and the teeth 142 are formed in the body 120. The grooves 140/teeth 142 have any destined cross-sectional configuration. In the illustrative example depicted in FIGS. 5 and 6, the grooves 140/teeth 142 have a generally rectangular cross-sectional configuration, but they could easily have other configurations if desired, e.g., a recess with a rounded bottom surface and a tooth with a corresponding rounded end. In the various embodiments depicted herein, there are four sets of mating grooves 140/teeth 142 for each support shoulder 109. In practice, any number of grooves 140/teeth 142 for device disclosed herein. In one illustrative embodiment, the illustrative grooves 140 have a depth 140D and a width 140W which may vary depending upon the particular application. In one illustrative example, the depth 140D may be about 0.5 inches, and the width 140W may be about 0.5 inches. In general, the dimensions of the mating teeth 142 will correspond approximately to the dimensions of the grooves 140.

In the embodiment shown in FIGS. 5 and 6 (and the other embodiments as well), the body 120 of the upper coupling 102 has a radial thickness 102T that is thicker than the radial thickness of the pipes 101A, 101B. The radial thickness of the pipes 101A, 101B is simplistically depicted by the double arrow 117 in FIG. 5. In one illustrative embodiment, the thickness 102T of the body 120 may be at least 50% greater than the thickness 117 of the pipes 101A, 101B. In some cases, the thickness 102T may be up to 100% greater than the thickness of the pipes 101A, 101B. In terms of absolute numbers, in many applications the wall thickness of the pipes 101A, 101B may be limited to about 1.6 inches. In that illustrative situation, the thickness 102T may be on the order of about 2.4 inches, depending upon the particular application. In the illustrative example when the body 120 is made from coupling stock, a body 120 having such additional thickness may be readily formed. In addition to providing load bearing structure to support the riser when the shoulders 111 are engaged, the additional thickness of the body 120 means that the tong contact area 126 (see FIG. 3) is, in a relative sense, very thick, thereby limiting the stresses induced when the coupling 102 is grabbed by a power tong (not shown). That is, the novel coupling 102 depicted herein provides a thicker tong contact area 126 where the marring, gouging and/or penetrations caused by the teeth of the power tong may be better tolerated, all of which tend to increase the useful life of the riser.

The body of the support member 109 has a radial thickness 119. In one illustrative embodiment, the radial thickness 119 may be on the order of about one inch, depending upon the particular application. With reference to FIG. 6, the retaining ring 132 has a radial thickness 131 that may be on the order of about 0.5 inches, depending upon the particular application. In one particular embodiment, the retaining ring 132 may be made of either a high-strength material or a low-strength material, such as carbon steel. Manufacturing the retaining ring 132 from a low-strength material may reduce the overall cost of the riser. With reference to FIG. 6, in the depicted example, the retaining ring 132 has a portion 132A that extends radially inward and is positioned above the upper surface 133 of the support member 109. In another configuration, the retaining ring 132 may be positioned such that the radially inward portion 132A is positioned below the support shoulders 111 of the support members 109, as indicated by the dashed lines for the retaining ring 132 in FIG. 6. That is, the orientation of the retaining ring 132 shown in FIGS. 5 and 6 may be flipped vertically such that the portion 132A is positioned beneath the load support shoulders 111 of the support members 109. In such an inverted configuration, the inward portion 132A of the retaining ring 132 will effectively become part of the support shoulder 111 of the support members 109 when the portion 132A is deflected under loaded conditions.

Figure 8:
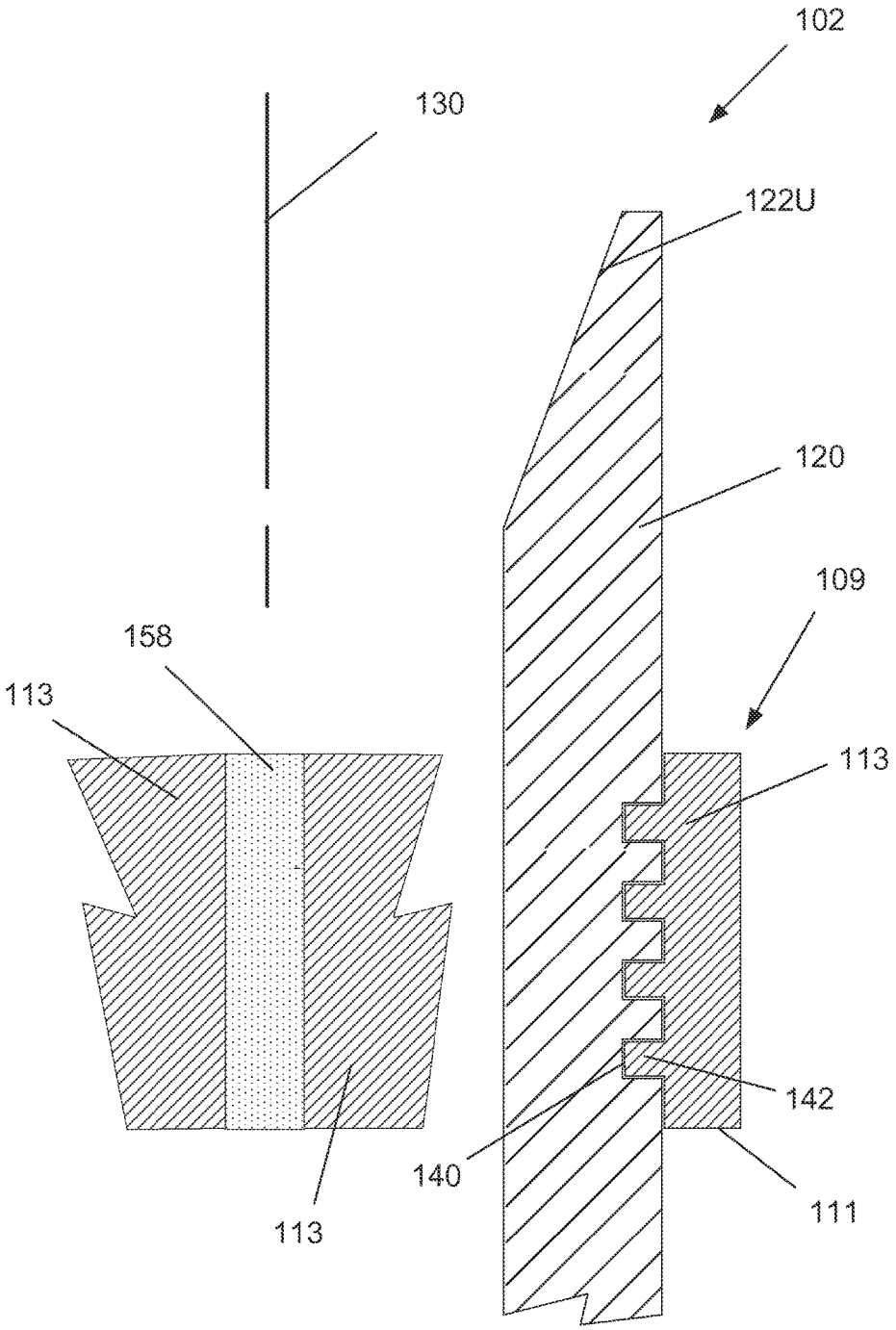

FIG. 8 depicts an embodiment where the support members 109 are initially manufactured as ring segments 113 and, after the ring segments 113 are positioned such that the grooves 140/teeth 142 are properly engaged, the ring segments 113 are welded together as reflected by the simplistically depicted weld seam 158. In the embodiment shown in FIG. 8, the retaining ring 132 may be omitted. If desired, the support member 109 may be disassembled from the engaged position with the body 120 by cutting the weld seams.

Figure 9:
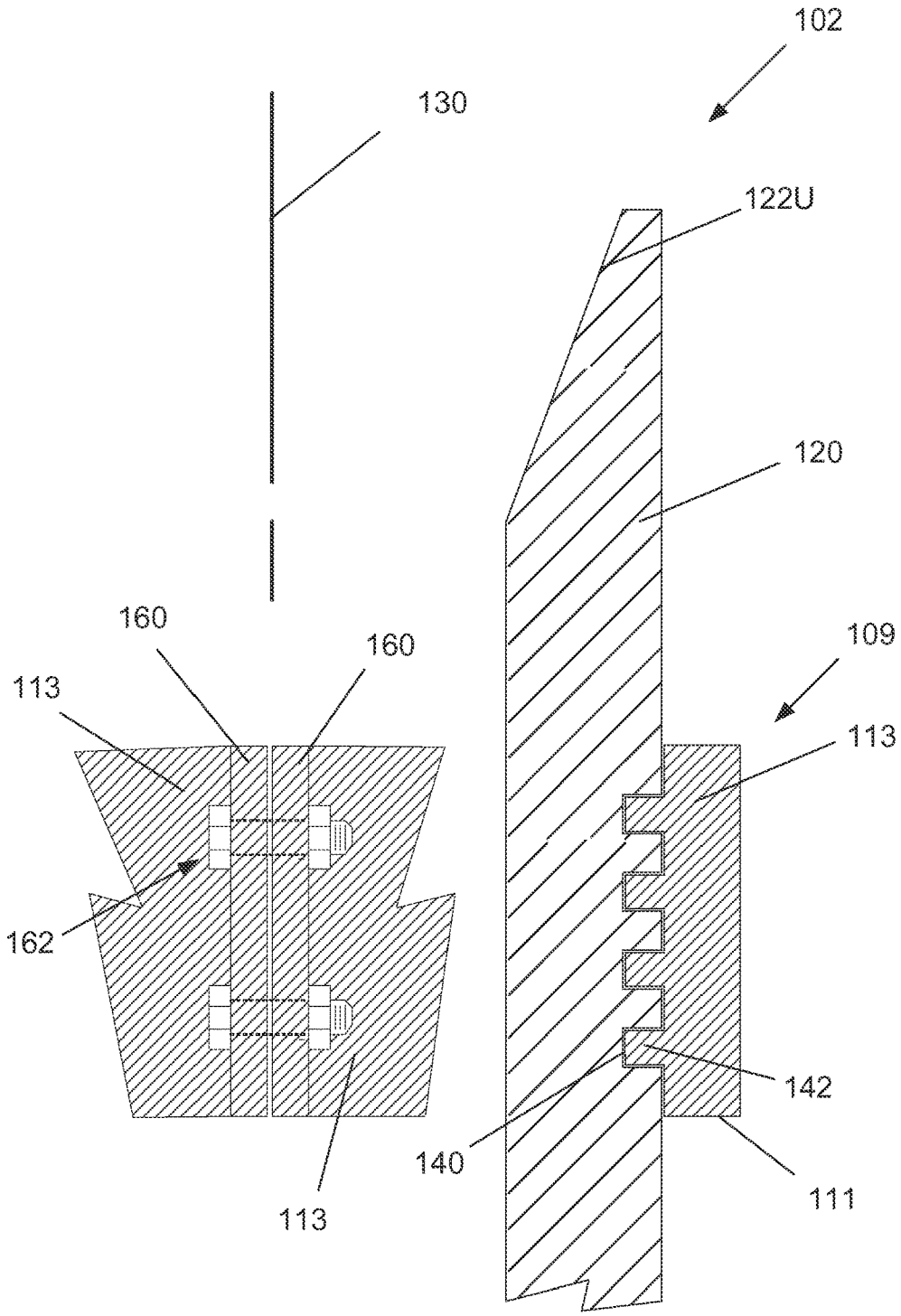

FIG. 9 depicts an embodiment where the support members 109 are initially manufactured as ring segments 113 that include flanges 160. After the ring segments 113 are positioned such that the grooves 140/teeth 142 are properly engaged, the ring segments 113 are coupled together using a plurality of mechanical fasteners 162, such as the illustrative threaded bolt/nut depicted in FIG. 9. Of course, other mechanical fasteners, such as rivets or screws could be used as well. In the embodiment shown in FIG. 9, the retaining ring 132 may be omitted. If desired, the support member 109 may be disassembled from the engaged position with the body 120 by removing the mechanical fasteners 162.

Figure 10:
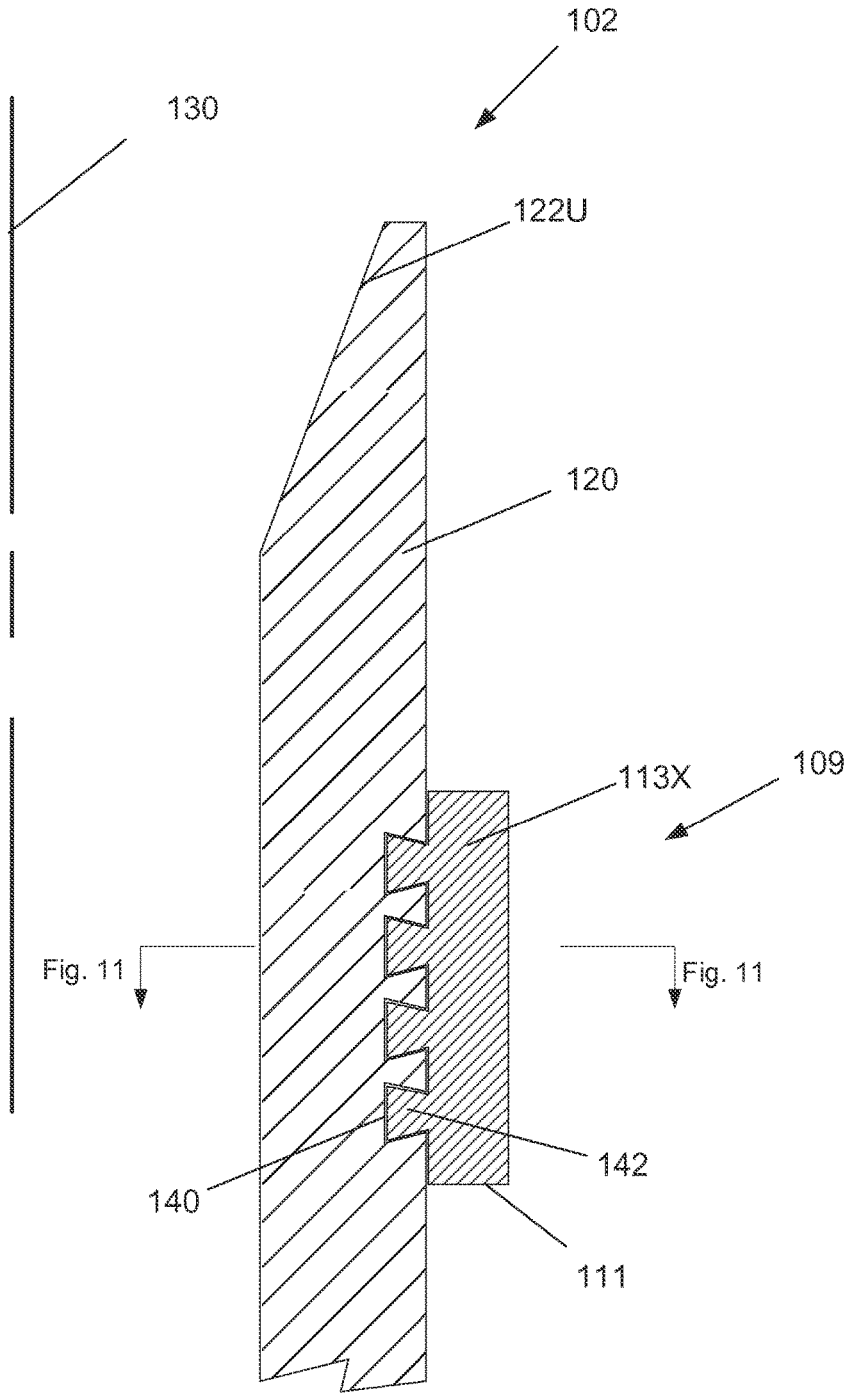
Figure 11:
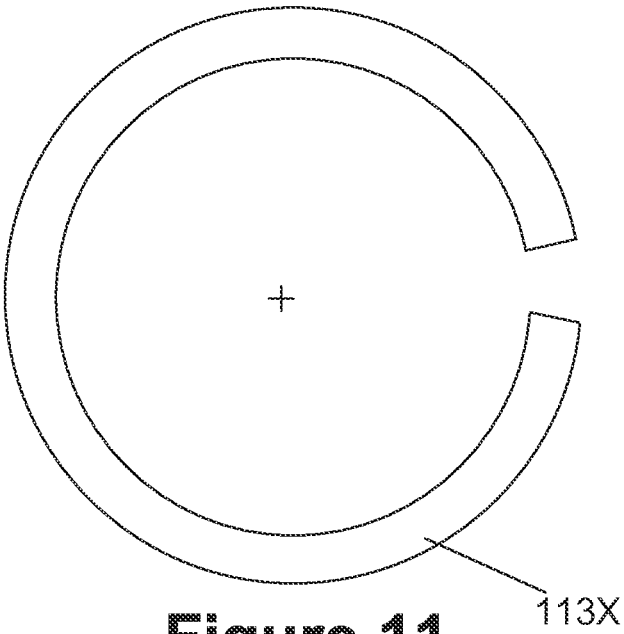

FIGS. 10 and 11 depict an illustrative embodiment wherein the each of the support members 109 has a one-piece partial ring segment 113 that has a "C" type configuration (when viewed in plan—see FIG. 11). That is, in this embodiment, the support member 109 acts much like a snap ring that may be positioned around the body 120 of the upper coupling 102 and urged radially inward until such time as the C-type ring segment 113X snaps into engagement with body 120. In one example, the C-type ring segment 113X may extend about 359 degrees around the circumference of the body 120. Note that in this embodiment, as shown in FIG. 10, the grooves 140, teeth 142 have a self-retaining cross-sectional configuration, e.g., trapezoidal, that prevents outward radial movement of the ring segment 113X once the grooves 140/teeth 142 are properly engaged with one another.

Figure 12:
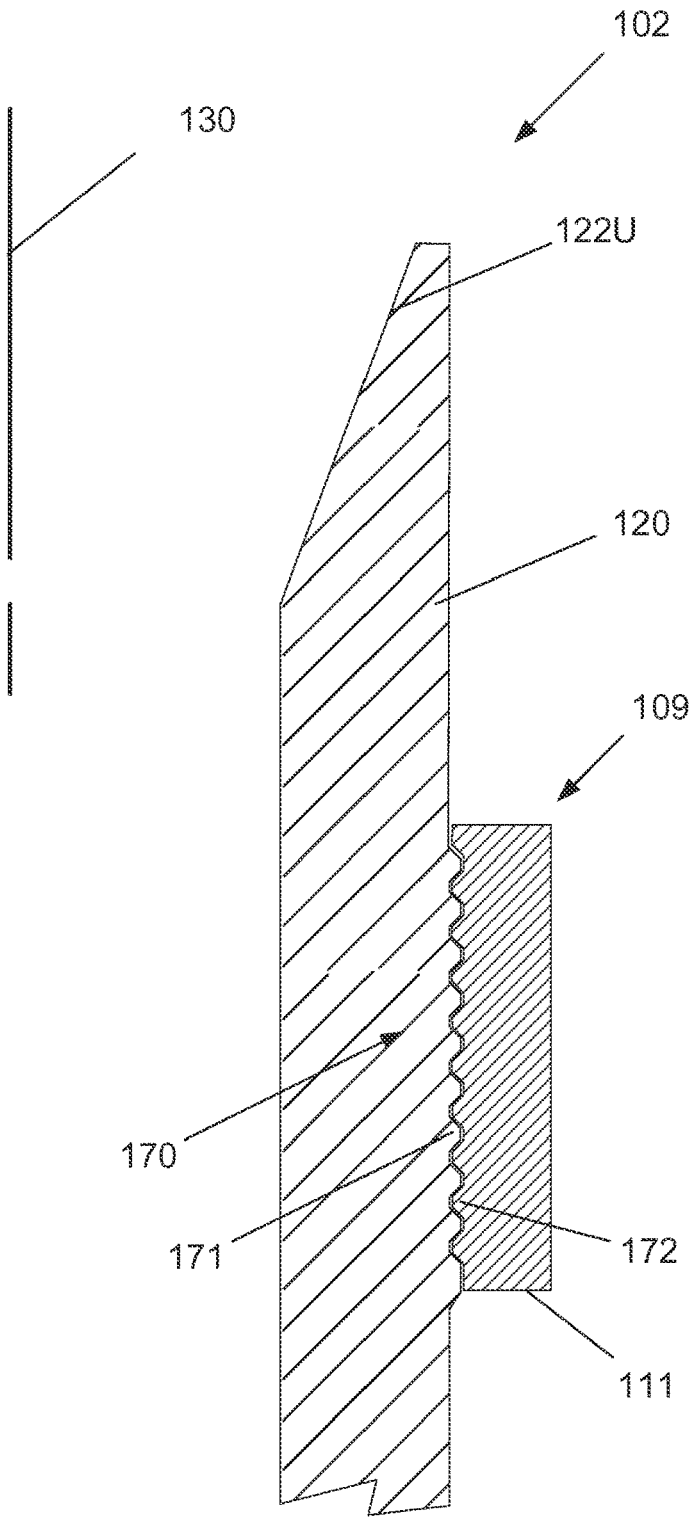

FIG. 12 depicts an embodiment where the support members 109 are cylindrical components that are coupled to the body 120 of the upper coupling 102 by a threaded connection 170. More specifically, external threads 171 are formed into the body 120 and matching internal threads 172 are formed on the cylindrical support member 109. In this embodiment, the loadings on the support members 109 are absorbed by the threaded connection 170.

Figure 13:
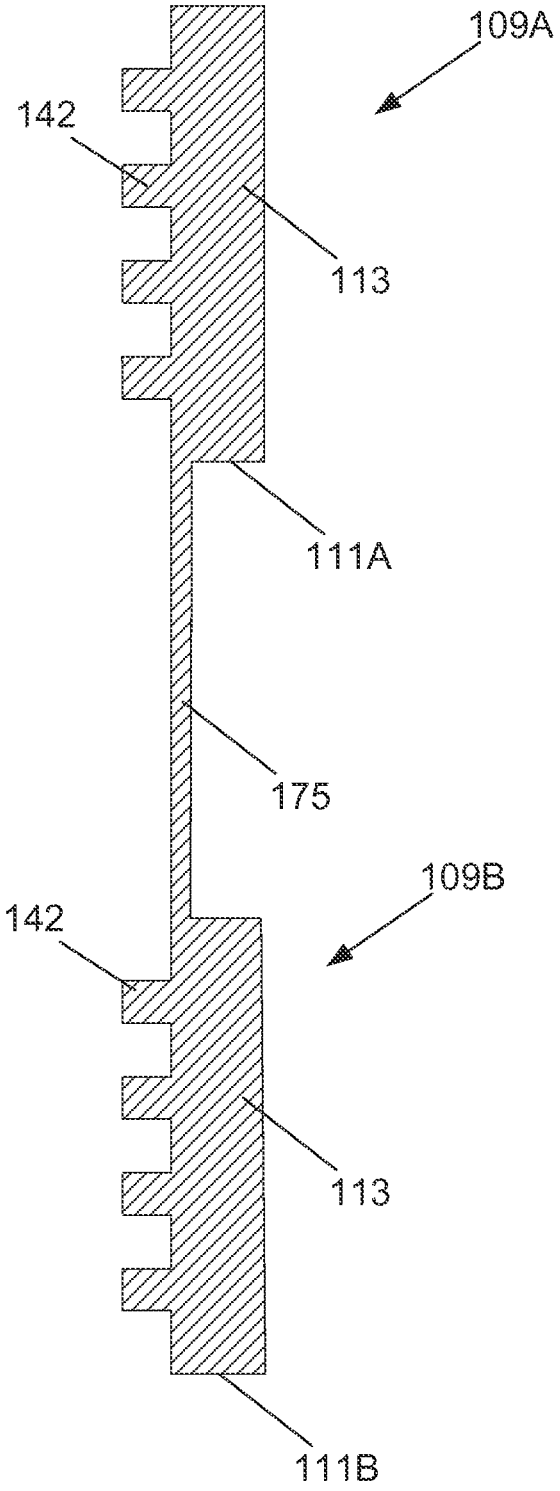

In the examples depicted herein, the illustrative support members 109 have been shown as being two vertically separated structures. However, if desired, the two support members 109 could be formed in such a manner that material extends between the support shoulder 111A of the upper support member 109A and the support shoulder 111B lower support member 109B. FIG. 13 depicts an example where a reduced thickness section of material 175 is located between the two support shoulders 111.

As will be appreciated by those skilled in the art after a complete reading of the present application, by providing a coupling 102 with the support members 109 described herein, handling of the pipe sections when assembling or disassembling a high-strength riser may be more readily accomplished by providing specifically designed load bearing shoulders 111 that are designed for their intended purpose. Additionally, the novel coupling 102 disclosed herein includes an "extra thick" contact area for the power tongs to engage the pipe sections thereby reducing the adverse impact of the scarring or gouging caused by use of power tongs when handling the pipe sections. Moreover, given the mechanical means of attaching the support members 109 to the coupling 102, the attachment can be readily accomplished at an on-shore manufacturing or assembly plant and the assembled coupling may be coupled to a pipe or a stand of pipes. Lastly, due to the mechanical nature of the attachment of the support members 109 to the body 120, the support members 109 may be readily removed from the body 120 and the grooves 140/teeth 142 and/or the threaded connection 170 may be inspected for damage and or refurbished as needed.

Figure 14:
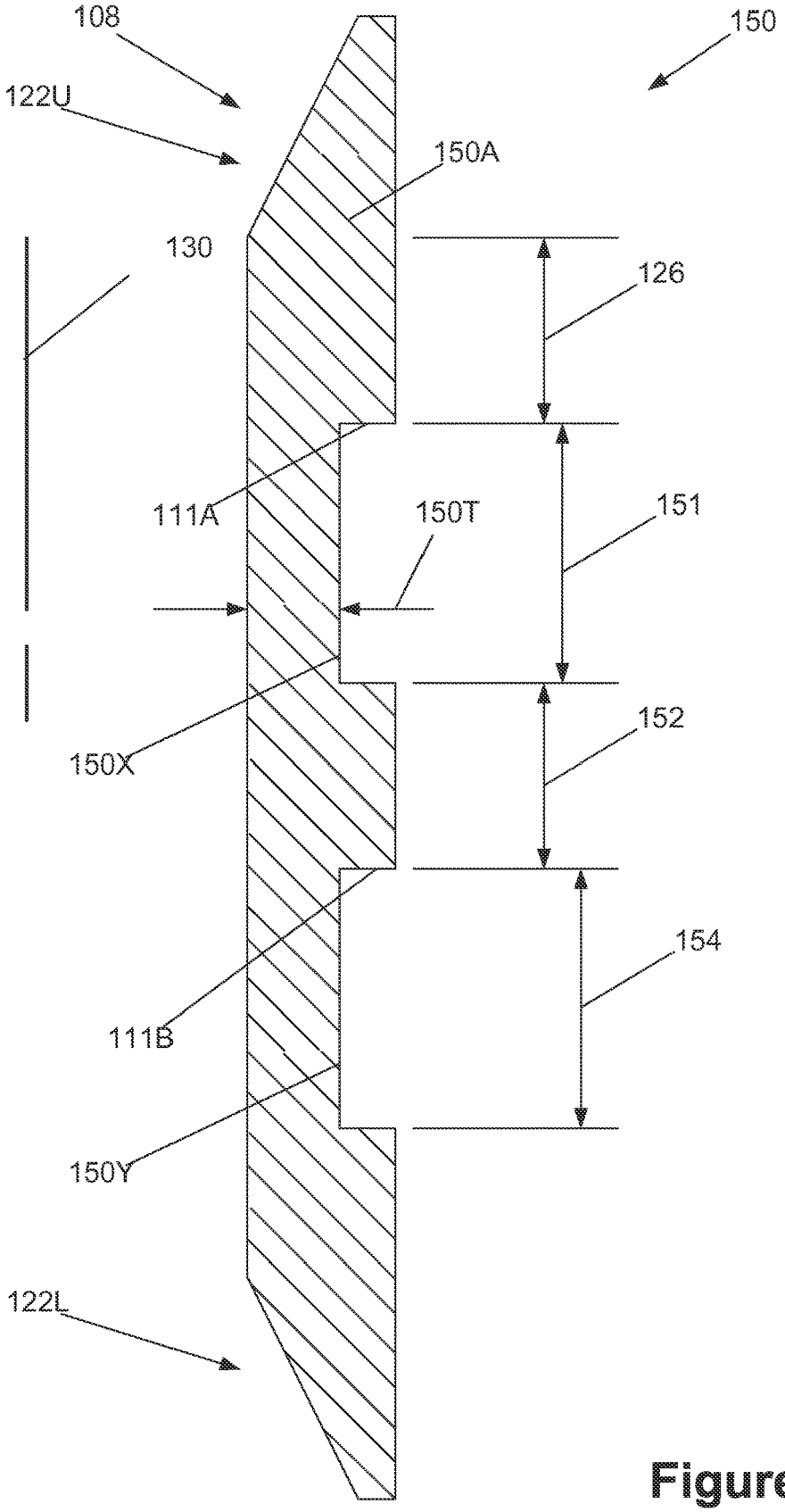
FIGS. 14-15 are yet other embodiments of a unique coupling for a high strength riser made from high strength coupling stock material with load shoulders defined therein.
Figure 15:
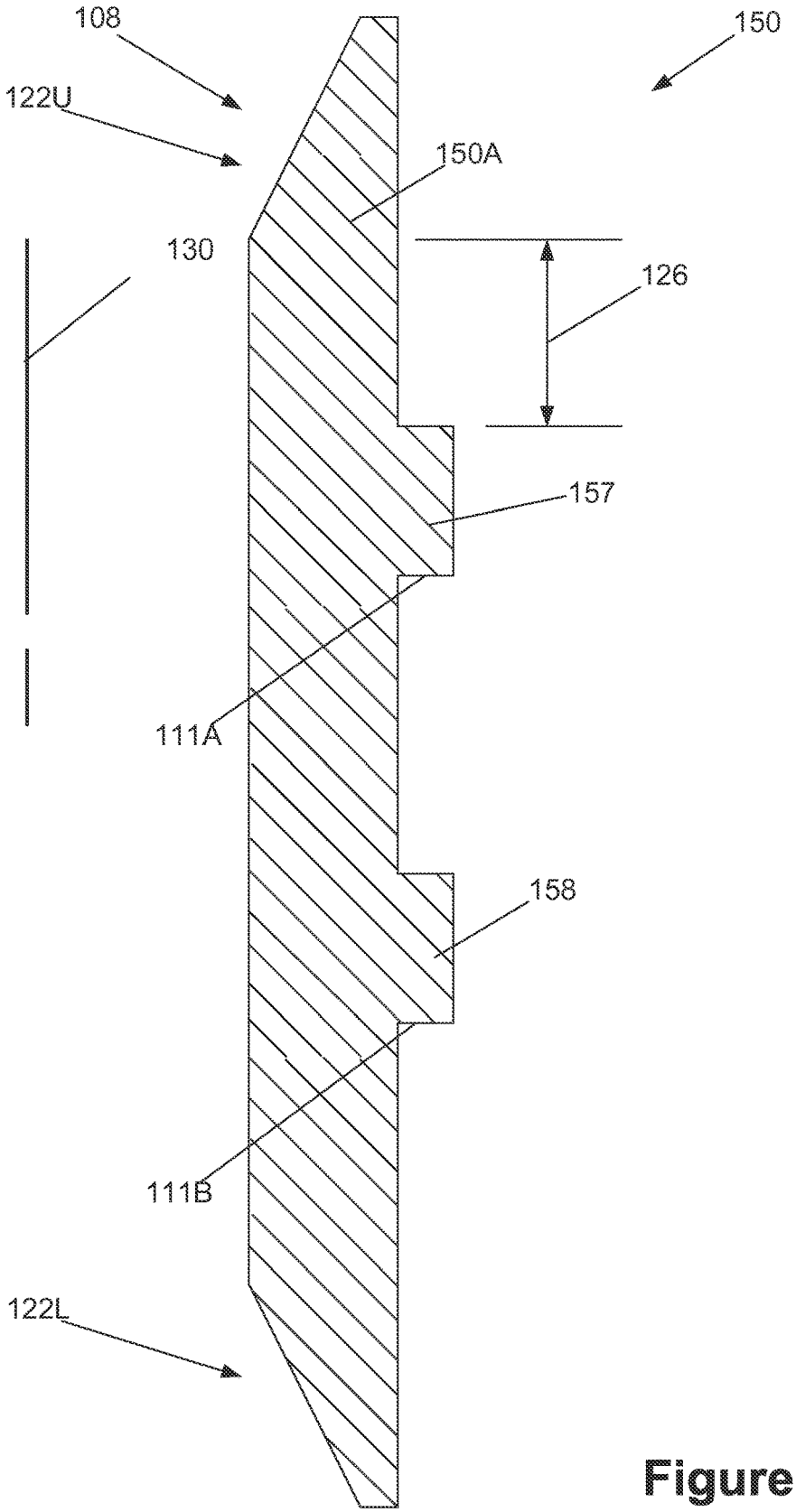

FIGS. 14-15 are yet other embodiments of a unique one-piece coupling 150 for a high strength riser made from high strength coupling stock material 150A with load shoulders defined therein by performing one or more machining operations. As shown in FIG. 14, the coupling 150 is comprised of a one-piece body 150 that is made of high-strength coupling stock material that is formed to a desired outside diameter and inside diameter using rolling and extrusion manufacturing techniques followed by the machining of the body to defined the various support shoulders, recesses and threads on or in the body 150A. The coupling comprises an upper box connection 122U that serves as the box connection 108 for the overall stand 100 and a lower box connection 122L that is adapted to be coupled to the pin connection of the pipe 101A. As depicted, various machining operations may be performed to define a plurality of recesses 150X, 150Y in the body 150A. The depth of the recesses 150X, 150Y is set such that the minimum thickness 150T between the inside wall of the coupling 150 and the bottom of the recesses 150X, 150Y is at least equal to the thickness required for the high-strength riser pipe, e.g., pipe 101A, that will be coupled to the coupling 150 at the lower box connection 122L. The overall axial length of the coupling 150 may vary depending upon the particular application, e.g., in one example it may be about 6.5 feet. The coupling 150 comprises the support shoulder 111A that is adapted to be engaged by an elevator (not shown) and the riser weight load support shoulder 111B that is adapted to be positioned in contact with a support structure on a vessel, e.g., an operations platform, so as to thereby support the entire weight of the riser positioned below the vessel when pipe stands 100 are being added to or removed from the riser. In the depicted example, the upper recess 150X has an axial length 151 while the lower recess 150Y has an axial length 154. In one illustrative example, the axial lengths 151, 154 may be the same and they may be about 20 inches. A tong gripping area 126 is provided above the upper recess 150X. In one illustrative example, the axial length of the tong gripping area 126 may be about 15 inches. The upper recess 150X and the lower recess 150Y are axially spaced apart by a distance 152 that may be about 3 inches. The high-strength body 150A of the one piece coupling 150 may be made to precise specifications and manufactured using known rolling and extrusion manufacturing techniques. Additionally, the coupling 150 may be attached to the pipe 101A in the factory using special equipment, i.e., using protective layers positioned between the tong dies and outside diameter of the pipe 101A.

FIG. 15 depicts anther embodiment wherein the coupling 150 is comprised of a one-piece body 150 that is made of high-strength coupling stock material that is formed to a desired outside diameter and inside diameter using rolling and extrusion manufacturing techniques followed by the machining of the body to defined the various support shoulders, and threads on or in the body 150A. In this example, machining operations are performed to define vertically spaced apart integral support members 157, 158 in the one-piece body 150A. The coupling 150 also comprises an upper box connection 122U that serves as the box connection 108 for the overall stand 100 and a lower box connection 122L that is adapted to be coupled to the pin connection of the pipe 101A. As depicted, the coupling 150 comprises the support shoulder 111A that is adapted to be engaged by an elevator (not shown) and the riser weight load support shoulder 111B that is adapted to be positioned in contact with a support structure on a vessel, e.g., an operations platform, so as to thereby support the entire weight of the riser positioned below the vessel when pipe stands 100 are being added to or removed from the riser. A tong gripping area 126 is provided above the upper support member 157. The upper support member 157 and the lower support member 158 are axially spaced apart by a distance sufficient for an elevator to engage the shoulder 111A on the upper support member 157.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A riser, comprising:

a first pipe stand and a second pipe stand, at least the first pipe stand comprising:

a length of pipe;

a coupling that is coupled to an upper end of the pipe, the coupling comprising a body; and an upper support member and a lower support member both of which are mechanically coupled to the body, the upper support member comprising an elevator engagement support shoulder, the lower support member comprising a riser weight load support shoulder that is adapted to support a weight load of the riser from a support structure, wherein the coupling with the upper support member and the lower support member coupled thereto is adapted to be lowered through the support structure after a lower end of the second pipe stand has been coupled to an upper end of the coupling.

2. The riser of claim 1, wherein the coupling is coupled to the pipe via a threaded connection.

3. The riser of claim 1, wherein materials of construction for the length of pipe and the coupling comprise high-strength materials that are in compliance with NACE specification MR0175.

4. The riser of claim 1, wherein each of the upper support member and the lower support member comprise a plurality of partial ring segments.

5. The riser of claim 4, wherein the upper and lower support members are mechanically coupled to the body by a plurality of mating grooves and teeth and wherein the grooves are formed in the body and the teeth are formed in the plurality of partial ring segments.

6. The riser of claim 4, wherein the upper and lower support members are mechanically coupled to the body by a plurality of mating grooves and teeth and wherein the grooves are formed in the plurality of partial ring segments and the teeth are formed in the body.

7. The riser of claim 4, wherein each of the upper support member and the lower support member further comprise a retaining ring that engages the partial ring segments.

8. The riser of claim 4, wherein each of the upper support member and the lower support member comprise two partial ring segments.

9. The riser of claim 4, wherein the partial ring segments are coupled to one another by at least one weld seam.

10. The riser of claim 4, wherein the partial ring segments comprise flanges and wherein the partial ring segments are coupled to one another by a plurality of fasteners that extend through the flanges.

11. The riser of claim 4, wherein the upper and lower support members are mechanically coupled to the body by a plurality of mating grooves and teeth and wherein the grooves are continuous grooves that are formed in the body around an entire circumference of the body.

12. The riser of claim 4, wherein the upper and lower support members are mechanically coupled to the body by a plurality of mating grooves and teeth and wherein both the grooves and the teeth have a generally rectangular cross-sectional configuration when viewed in a cross-section taken through the coupling in a plane that includes a centerline of the coupling.

13. The riser of claim 1, wherein each of the upper support member and the lower support member is a one-piece partial ring segment that extends around less than an entire circumference of the body.

14. The riser of claim 13, wherein the upper and lower support members are mechanically coupled to the body by a plurality of mating grooves and teeth and wherein both the grooves and the teeth have a cross-sectional configuration when viewed in a cross-section taken through the coupling in a plane that includes a centerline of the coupling, that, when the teeth are positioned within the grooves, movement of the one-piece partial ring segment away from the body in a radial direction that is traverse to a centerline of the coupling is restrained.

15. The riser of claim 13, wherein the upper and lower support members are mechanically coupled to the body by a plurality of mating grooves and teeth and wherein both the grooves and the teeth have a generally trapezoidal cross-sectional configuration when viewed in a cross-section taken through the coupling in a plane that includes a centerline of the coupling.

16. The riser of claim 1, wherein the upper and lower support members are mechanically coupled to the body by a threaded connection and wherein each of the upper support member and the lower support member are cylindrical structures that comprise internal threads formed therein that are adapted to engage external threads formed on the body.

17. The riser of claim 1, wherein the upper support member and the lower support member are physically separate structures that are vertically spaced-apart from one another and wherein a portion of an outer surface of the body is exposed between the upper support member and the lower support member.

18. The riser of claim 1, wherein the body is made of coupling stock material that is in compliance with NACE specification MR0175.

19. The riser of claim 1, wherein the upper support member and the lower support member are made of a forged material.

20. The riser of claim 1, wherein the support structure comprises an operations platform.

21. The riser of claim 1, further comprising a third pipe stand, wherein the second pipe stand comprises:

a second length of pipe;

a second coupling that is coupled to an upper end of the second pipe, the second coupling comprising a second body; and a second upper support member and a second lower support member both of which are mechanically coupled to the second body, the second upper support member comprising a second elevator engagement support shoulder and the second lower support member comprising a second riser weight load support shoulder that is adapted to support a weight load of the riser from the support structure, wherein the second coupling with the second upper support member and the second lower support member coupled thereto is adapted to be lowered through the support structure after a lower end of the third pipe stand has been coupled to an upper end of the second coupling.

* * * * *